US006821303B2

(12) United States Patent
Polsky

(10) Patent No.: US 6,821,303 B2
(45) Date of Patent: Nov. 23, 2004

(54) METHOD AND KIT FOR BATIK ART

(75) Inventor: Nathan Polsky, Boynton Beach, FL (US)

(73) Assignee: Scratch-Art Company, Avon, MA (US)

( * ) Notice: Subject to any disclaimer, the term of this patent is extended or adjusted under 35 U.S.C. 154(b) by 41 days.

(21) Appl. No.: 10/290,449

(22) Filed: Nov. 8, 2002

(65) Prior Publication Data

US 2004/0088803 A1 May 13, 2004

(51) Int. Cl.[7] ..... D06P 5/12

(52) U.S. Cl. ..... 8/447; 8/478; 206/223; 206/575; 434/88

(58) Field of Search ..... 8/447, 478; 434/88, 434/87; 206/223, 575

(56) References Cited

U.S. PATENT DOCUMENTS

| | | | | | |
|---|---|---|---|---|---|
| 3,789,756 | A | * | 2/1974 | Weber | 101/128.21 |
| 3,840,113 | A | | 10/1974 | Bartleson | |
| 4,128,057 | A | | 12/1978 | Hayama et al. | |
| 4,254,520 | A | | 3/1981 | Saurman | |
| 4,279,674 | A | | 7/1981 | Wadden | |
| 4,308,633 | A | | 1/1982 | Van Huffel et al. | |

* cited by examiner

*Primary Examiner*—Margaret Einsmann
(74) *Attorney, Agent, or Firm*—Browdy and Neimark, P.L.L.C.

(57) ABSTRACT

A method for Batik art involves the use of pressure through a stylus to transfer wax from a transfer sheet onto a receiving base or substrate. Following transfer to the substrate or base, the areas between the wax may be painted such as with water colors, after which the transferred wax may be removed if desired.

20 Claims, No Drawings

METHOD AND KIT FOR BATIK ART

FIELD OF THE INVENTION

The present invention relates to the creation of art using modified and simplified batik techniques.

BACKGROUND OF THE INVENTION

Traditionally the art of batik consists of melting waxes so that they flow and are applied to a cloth material such as cotton, silk, etc. All areas are thus covered except for what is left "open" to receive the specific color desired. This is repeated color by color, using water-based coloring materials.

Various tools and instruments are employed for such controlled wax application, notably an instrument called a tjanting needle, a hand-held device with a front reservoir cup which holds the melted wax, applying it to the working surface of the art or decoration through an end aperture. There are other types of wax-feeding funnel devices as well. These, as well as brushes, have been used especially for applying fine or thin lines of wax for resist purposes, since the concept of the technique is the resist phenomenon of the wax for preventing the water-base coloring materials from penetrating and adhering to the base fabric material or other substrate.

Such water-base coloring materials, e.g. inks, dyes or paints, have been applied by brushing within the areas of exposed material not waxed, with the waxed lines and areas that were previously applied resisting or rejecting the water-base colors to form white, open lines and areas, or such lines and areas of whatever the original base material color was.

Besides brushing in the separate colors within the demarcations created by the waxed application, a further method has been to dip the base material being worked on into a tub, pan or other container of the desired color.

When the next, additional colors are to be applied to those lines and areas which previously had been covered by the wax barrier, it is necessary to remove the earlier applied wax by laying the waxed side down onto some absorbent surface and pressing over the back with a heated iron or the like. This causes the wax areas to melt and be transferred to the underlying absorbent material. Removing the wax in this manner exposes these once-sealed areas for additional new water-base color applications.

All the other areas not intended to be colored must, in turn, be covered with the resist wax applied, as already described, by applying melted wax in the selected pattern, re-dying, and then with subsequent removal of the wax. Some practitioners remove the wax but do not add another color, to retain the white or base color effect.

Many batik artists permit the lines and other larger areas of the work to remain white (or the color of the base material) by allowing the wax to remain in place without heating and removing. This produces an interesting white contour or definition line between the other applied colors, which serves to demarcate the figures, objects or patterns. The final effect is not unlike stained glass leading between each color, except that the batik "leading" is the white of the base.

From the above outline of the batik process, it can be seen that the traditional art of batik is not an easy or rapid one. The appropriate means for heating, wax material, special fabric foundations, tools, containers, space, etc. are basic and necessary. Thus, a simplified system for producing batik-like effects more easily would surely be welcome.

SUMMARY OF INVENTION

Such a simplified and convenient method has been devised according to the present invention, without potential injuries from the heating requirement and the complete elimination of any awkward, expensive customary tools. Further, there is no need to purchase, store or melt any wax at all according to the present invention.

The method involves placing a wax coated transfer or carrier sheet on a substrate to which it is desired to transfer a wax coating from the transfer or carrier sheet in a particular pattern, followed by creating the pattern by pressing an upper surface of the carrier or transfer sheet with a stylus, without melting the wax, to transfer the wax by pressure to the substrate.

DETAILED DESCRIPTION OF EMBODIMENTS

The working wax is conveniently pre-coated on a carrier or transfer sheet that is clean, easy to handle and to store, and also easy to effortlessly distribute to a group of artists or students, without damaging the wax.

The wax coating, pre-applied to the carrier sheet in the manufacturing process, presents itself as a cold surface, with no heat at all necessary to effect transfer of the wax to the desired substrate, but able to be transferred just by means of pressure, using a stylus, i.e. any relatively narrow ended tool. With this new method, it is possible to produce very fine, controlled lines for contouring, shading and area demarcation in the white (or other color) of the base or substrate surface, all accomplished with minimum effort and quickly, and with the further benefit of eliminating the conventionally needed cloth or other fabrics, substituting instead simple paper as the receiving substrate, making the batik method available to even young children in a home or classroom setting, with a minimum of supervision.

Any pointed or other tool, such as a stick, pencil, ballpoint pen, or other stylus could be used for the drawing of lines of areas. A tool with a broader flat tip can be used for larger areas. In either case, the technique involves the transfer of the wax to the underlying "picture" sheet simply by using pressure when using the tool on the wax coated carrier sheet.

The waxes used should be soft and may be any of paraffin, beeswax, microcrystalline or other waxes in combination or alone, applied in manufacturing process on bleached paper, Kraft paper, parchment paper or other carrier sheets. No special carrier or transfer sheet is necessary as only the surface of the wax adheres to the carrier sheet.

An additional advantage of this new method is that a guide picture may be lightly drawn by the user upon the top surface of the carrier sheet, i.e. the side opposite the wax coating, thus assisting with the composition, color suggestions, etc. Such a drawing guide should, of course, be done sufficiently lightly, e.g. in pencil, etc., to avoid inadvertently transferring the wax coating. Another option is to provide the carrier sheet, on its top surface opposite the wax coating, with a pre-printed pattern or picture to guide the user. A third option is to provide additional sheets with guide pictures thereon, i.e. the aforementioned pre-printed pattern or picture to guide the user, except on separate sheets independent of the transfer or carrier sheet, for placement thereover during use. Pressing heavily, when ready, will effect the wax transfer to the base or substrate.

Another method of preparing a pattern guide that avoids inadvertent transfer of the wax is simply to prepare the drawing on some other plain sheet, doing whatever erasing and corrections are needed, and then using this final drawing as the guide over the wax-carrying transfer sheet, proceeding to press as required onto the final substrate work sheet. The best wax transfer occurs when pressing heavily. It is also possible to use as such a guide any art or picture obtained from any printed matter.

Thus, the demarcation wax contour lines may be deposited where desired using this cold wax method and application in the manner described. The pre-waxed sheets may be easily handled without fear or dislodging or disturbing the wax surface.

Once the transferred wax "leading" demarcating the outline design or picture is drawn using such wax carrier sheet, specific areas of the picture may be filled in and painted with various water colors. Such painted colors are retained within their respective areas because of the resist effect of the transferred wax demarcations. Again, the final effect is not unlike stained glass leading between each color, except that the batik "leading" is the white of the base paper, or the color of the base paper if a colored base or substrate paper is selected.

Instead of separate color areas brushed in place, another interesting variation is to apply by brushing (or roller coating) one or more over-all color or colors over the entire base sheet as background. For best results, it has been found that common clay coated paper works best as the substrate receiving surface, although an uncoated paper or other types of bases or substrates can also be used.

The wax may be applied to the carrier paper using a common manufacturing technology involving dipping carrier paper into a container holding the molten wax, e.g. for both sides coating, or by surface coating on one or both sides in any of the known procedures, preferably at the rate of about 7 lbs per ream (500 sheets of 24×36 inches) for one side coating or 13–15 lbs per ream (500 sheets of 24×36 inches) for two sides coating. Lesser quantities of wax can also be used. The waxed sheeting is then passed over a chill roller to immediately cool the wax and thus permit the paper to be wound into a roll ready for subsequent slitting and sheeting to the required size.

It should be pointed out that while transparent wax has been assumed throughout the above descriptions, colored waxes may also be used, including solid colored white.

While it is not suggested that the above described cold wax process will replace the labor-intensive traditional batik method, the present system indeed does offer a very simple, inexpensive, safe variation that will provide an artistic alternative for young and old, so all may enjoy the special qualities of batik painting, without the negative difficulties and impediments.

Such pre-prepared wax-coated sheets provided to the user/artist immediately ready for utilization with the proper wax formulation adhered should contribute to the widespread popularization of this art.

Sheets of wax coated transfer paper together with substrates or bases, preferably of paper, together with at least one stylus, may be provided in kit form. More basic kits can be provided without either the stylus or the receiving substrates. Alternatively, a more complete kit can include more than one stylus, each having a different tip size, and/or a plurality of sheets with guide pictures thereon. The kit also desirably includes directions for use.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A method for creating Batik art, comprising placing a transfer or carrier sheet provided on a bottom surface thereof with a wax layer coating on a substrate to which it is desired to transfer a part of the wax coating layer from said transfer or carrier sheet in a pattern, pressing an upper surface of said carrier or transfer sheet with a stylus in the absence of an amount sufficient of heat to cause melting of said wax, to thereby transfer by pressure wax from said bottom surface of said transfer or carrier sheet to said substrate in a pattern according to the movements of the stylus controlled by the user, optionally removing the transfer or carrier paper from the substrate, and coloring some or all portions of said substrate which are not wax coated using a single or a plurality of colors.

2. The method of claim 1 wherein said substrate is white paper.

3. The method of claim 1 wherein said substrate is colored paper.

4. The method of claim 1 wherein said removing of the transfer of carrier paper from the substrate is carried out.

5. The method of claim 4 wherein said substrate is white paper.

6. The method of claim 4 wherein said substrate is colored paper.

7. The method of claim 1, wherein said coloring using a single or a plurality of colors comprises coloring with a plurality of water colors.

8. The method of claim 4, wherein said coloring using a single or a plurality of colors comprises coloring with a plurality of water colors.

9. The method of claim 1, wherein said substrate is clay coated paper.

10. The method of claim 4, wherein said substrate is clay coated paper.

11. The method of claim 1, wherein said coloring comprises coloring with a plurality of colors.

12. The method of claim 4, wherein said coloring comprises coloring with a plurality of colors.

13. A kit for creating Batik artwork according to claim 1, comprising a plurality of wax coated transfer or carrier sheets, some or all of which are optionally provided on an upper surface thereof with a guiding pattern;

optionally a plurality of sheets with guide pictures thereon for use as guidance to the user for placement over the carrier sheet to assist in picture transfer to the receiving surface substrate therebeneath during wax transfer;

optionally a plurality of receiving substrates which are optionally clay coated paper, optionally some of which are white and some of which are colored;

at least one stylus; and directions for use.

14.The kit of claim 13, wherein said plurality of receiving substrates are present in said kit.

15. The kit of claim 13, further comprising at least one additional stylus.

16. The kit according to claim 13, wherein at least some of said plurality of receiving substrates comprise clay coated paper.

17. The kit according to claim 13, wherein said plurality of receiving substrates comprise some white sheets of paper and some colored sheets of paper.

18. The kit according to claim 13, wherein at least some of said wax coated transfer or carrier sheets are provided on an upper surface thereof with said guiding pattern.

19. The kit according to claim 13, further comprising water color paints.

20. A kit for creating Batik artwork according to claim 1, comprising a plurality of wax coated transfer or carrier sheets, some or all of which are optionally provided on an upper surface thereof with a guiding pattern;

a plurality of sheets with guide pictures thereon for use as guidance to the user for placement over the carrier sheet to assist in picture transfer to the receiving surface substrate therebeneath during wax transfer;

a plurality of receiving substrates which are optionally clay coated paper, optionally some of which are white and some of which are colored;

at least one stylus; and directions for use.

* * * * *